US010272484B1

(12) United States Patent
Stephens et al.

(10) Patent No.: US 10,272,484 B1
(45) Date of Patent: Apr. 30, 2019

(54) PRESS FOR FORMING JEWELRY FROM SILVERWARE

(71) Applicants: Janis J. Stephens, Winter Garden, FL (US); Allen Keith Stephens, Winter Garden, FL (US)

(72) Inventors: Janis J. Stephens, Winter Garden, FL (US); Allen Keith Stephens, Winter Garden, FL (US)

(73) Assignee: Wrapsody Jewelry Studio, LLC, Winter Garden, FL (US)

( * ) Notice: Subject to any disclaimer, the term of this patent is extended or adjusted under 35 U.S.C. 154(b) by 0 days.

(21) Appl. No.: 16/156,138

(22) Filed: Oct. 10, 2018

Related U.S. Application Data

(60) Provisional application No. 62/597,997, filed on Dec. 13, 2017.

(51) Int. Cl.
*B21D 53/44* (2006.01)

(52) U.S. Cl.
CPC ..... *B21D 53/44* (2013.01)

(58) Field of Classification Search
CPC ..... B21D 5/01; B21D 11/10; B21D 53/44; B30B 1/02; B30B 1/04; Y10T 29/4959; Y10T 29/49593
See application file for complete search history.

(56) References Cited

U.S. PATENT DOCUMENTS

| | | | | |
|---|---|---|---|---|
| 1,187,141 | A * | 6/1916 | Goldberg | B21D 5/02 29/8 |
| 2,465,101 | A | 3/1949 | Johnson | |
| 3,686,922 | A | 8/1972 | Bley | |
| 4,016,741 | A * | 4/1977 | Sitter | B21D 31/06 29/896.411 |
| 5,685,730 | A | 11/1997 | Cameron et al. | |
| 2004/0179910 | A1 | 9/2004 | Theising et al. | |
| 2005/0175423 | A1 | 8/2005 | Ku et al. | |

OTHER PUBLICATIONS

Flatwearable Artisan Jewelry Inc. photos published on Internet before Dec. 2017. Submitted herewith in pdf format. Current URL is www.flatwearable.net.

* cited by examiner

*Primary Examiner* — Debra M Sullivan
(74) *Attorney, Agent, or Firm* — John V. Stewart

(57) ABSTRACT

A workpiece bending press has a vertical ram with a lateral through-hole near the bottom. A first elongated mandrel has an end that mounts in the through-hole. The first mandrel mounting end has a cavity that receives an end of a second mandrel. The first mandrel then extends from a first side of the ram, and the second mandrel extends from the opposite side of the ram. Workpiece forming blocks may be placed under each mandrel, providing two different mandrels and forming blocks on the ram at once for different pressing stages or different workpiece diameters. One or both mandrels may be part of a set of interchangeable mandrels with different outer diameters. The ram may be operated by a lever that is quickly movable to the left or right side of the press for convenient use of mandrels extending from the left and right sides of the ram.

20 Claims, 5 Drawing Sheets

FIG 3
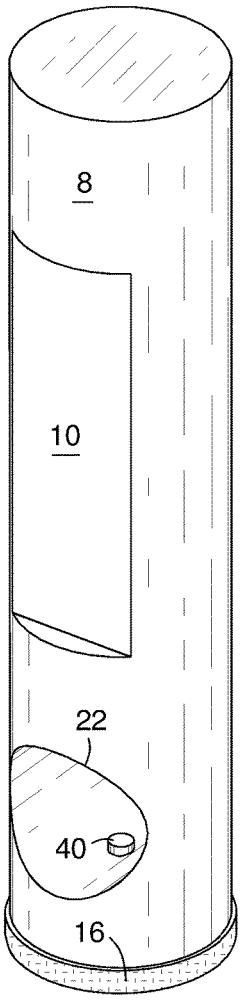
FIG 5
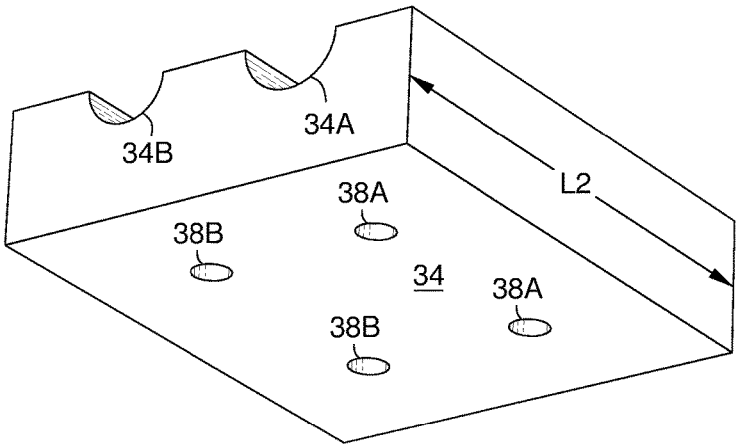
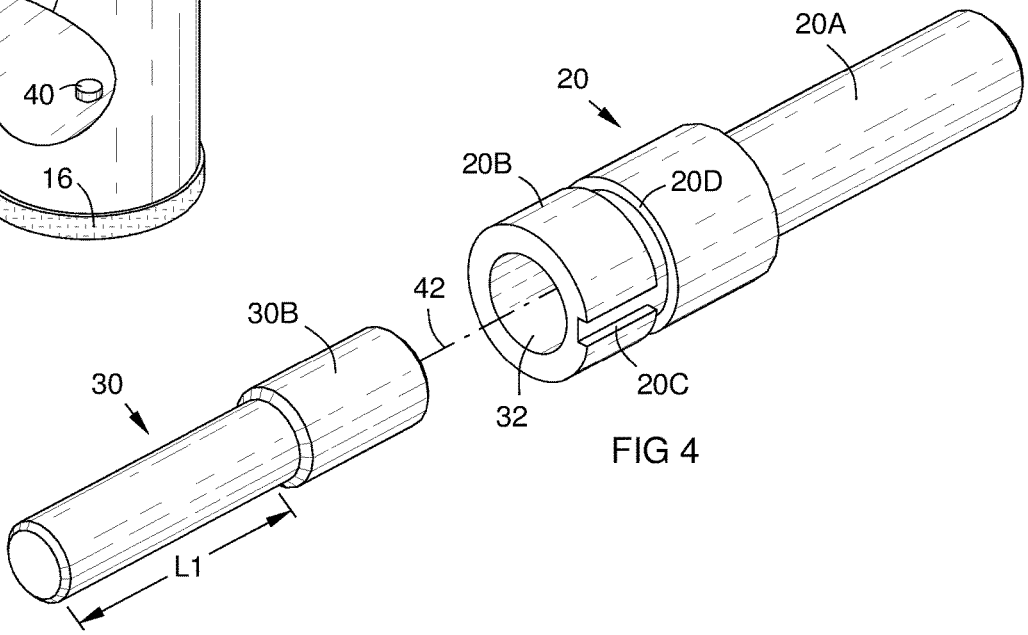
FIG 4

PRESS FOR FORMING JEWELRY FROM SILVERWARE

CROSS-REFERENCE TO RELATED APPLICATIONS

This application claims benefit of U.S. provisional patent application 62/597,997 filed Dec. 13, 2017 which is incorporated herein by reference in its entirety.

FIELD OF THE INVENTION

This invention relates to machines for bending silverware into wearable rings, bracelets and other jewelry.

BACKGROUND OF THE INVENTION

Jewelry such as rings and bracelets can be made by bending spoons, forks, and knives, called "flatware" or "silverware", and other flat metal workpieces. Devices are available for this bending process, but they have the following disadvantages:

1) Most benders or presses require much strength on the part of the artist to bend silverware that cannot be annealed, such as silver plated steel silverware.

2) Most benders or presses require additional hand tools and a cumbersome process to setup the machine or to change from one style of jewelry-making to another, for example from making rings to making bracelets.

3) Some benders or shaping tools are very heavy and cumbersome to transport, weighing 50 lbs. or more.

BRIEF DESCRIPTION OF THE DRAWINGS

The invention is explained in the following description in view of the drawings that show:

FIG. 3 is a perspective side view of the ram of the press.

FIG. 4 is an exploded perspective view of a first mandrel and ring forming mandrel.

FIG. 5 is a perspective bottom view of a ring-forming block.

DETAILED DESCRIPTION OF THE INVENTION

Figure 1:
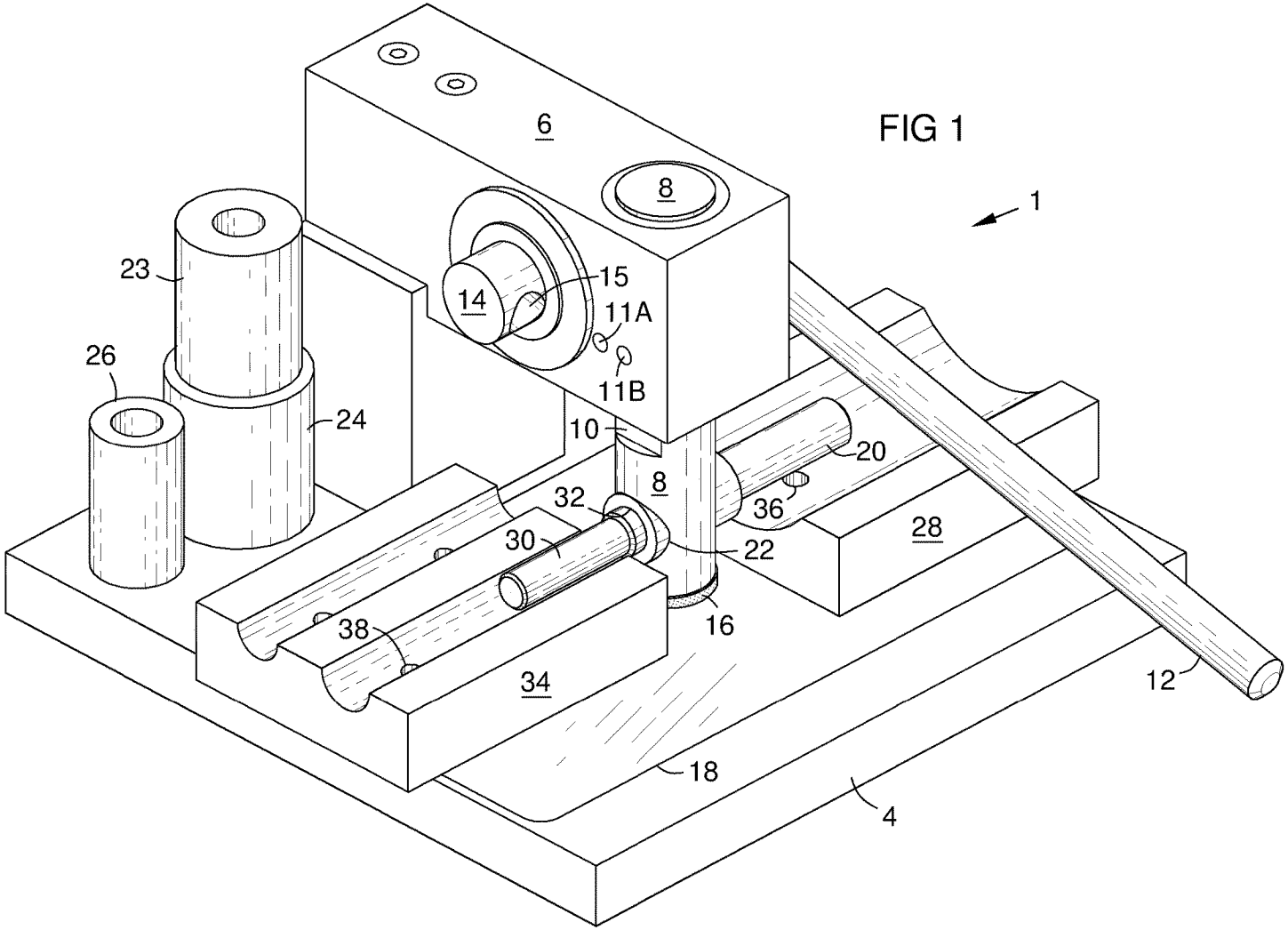
FIG. 1 is a perspective view of a jewelry-making press in accordance with aspects of the invention.

FIG. 1 shows a press 1 with a horizontal base 4 supporting a structure with a horizontal support arm 6. A ram 8 is mounted in the support arm for vertical motion. It may have a flat side portion 10 for rotational indexing. Two adjustment screws 11A, 11B may be provided in the support arm to tighten against the flat 10 to adjust resistance and rotation angle of the ram. A manual lever 12 or other actuating mechanism turns a horizontal axle 14 in the support arm 6. The axle 14 may extend from both the left and right sides of the support arm and provide a mount 15 on each side for alternate left and right handed use of the lever 12. A rotary-to-linear coupling such as a rack-and-pinion mechanism converts rotation of the axle to vertical linear motion of the ram. The bottom end of the ram may have a soft pad 16 for flattening of spoons or other silverware against a metal portion 18 of the base 4 in preparation for bending. To save weight, the base 4 may be made for example of wood, aluminum, or plastic with a steel plate 18 on top.

A mandrel/receiver 20 is inserted into a lateral through-hole 22 in the ram, and is retained therein by a pin as later shown. The mandrel/receiver supports a selected bracelet forming sleeve 23, 24, 26 that slips over the mandrel/receiver 20 as later shown for pressing silverware against a bracelet forming block 28. A selected second mandrel 30 such as a ring forming mandrel slips into a receiving cavity 32 in the proximal end of the mandrel/receiver 20 as later shown, so that the second mandrel 30 extends laterally from the opposite side of the ram 8 from the mandrel/receiver 20 for pressing silverware against a ring forming block 34. This provides forming blocks 28, 34 on two sides of the ram 8 with pressing tools 20, 30 of two different sizes, allowing a user to quickly switch sides for different parts of a project. The lever 12 can be quickly switched from left to right as later described to make it more convenient to the opposite hand from the workpiece-holding hand. A selection of bracelet forming sleeves 23, 24, 26 and ring mandrels 30 of different diameters are interchangeably mountable in the ram without tools. They may be stored on pins and/or blind holes on the base 4 behind the work area. The mandrels may be elongated cylinders as shown or other shapes, including extrusions of polygons.

A selection of bracelet forming blocks 28 and ring forming blocks 34 of different sizes may be provided. They are quickly interchangeable on the base 4 via vertical pins on the metal plate 18 later shown. Holes 36, 38 in the blocks 28, 34 for these pins are visible. These holes may be through-holes as shown or blind holes in the bottom of the blocks.

Figure 2:
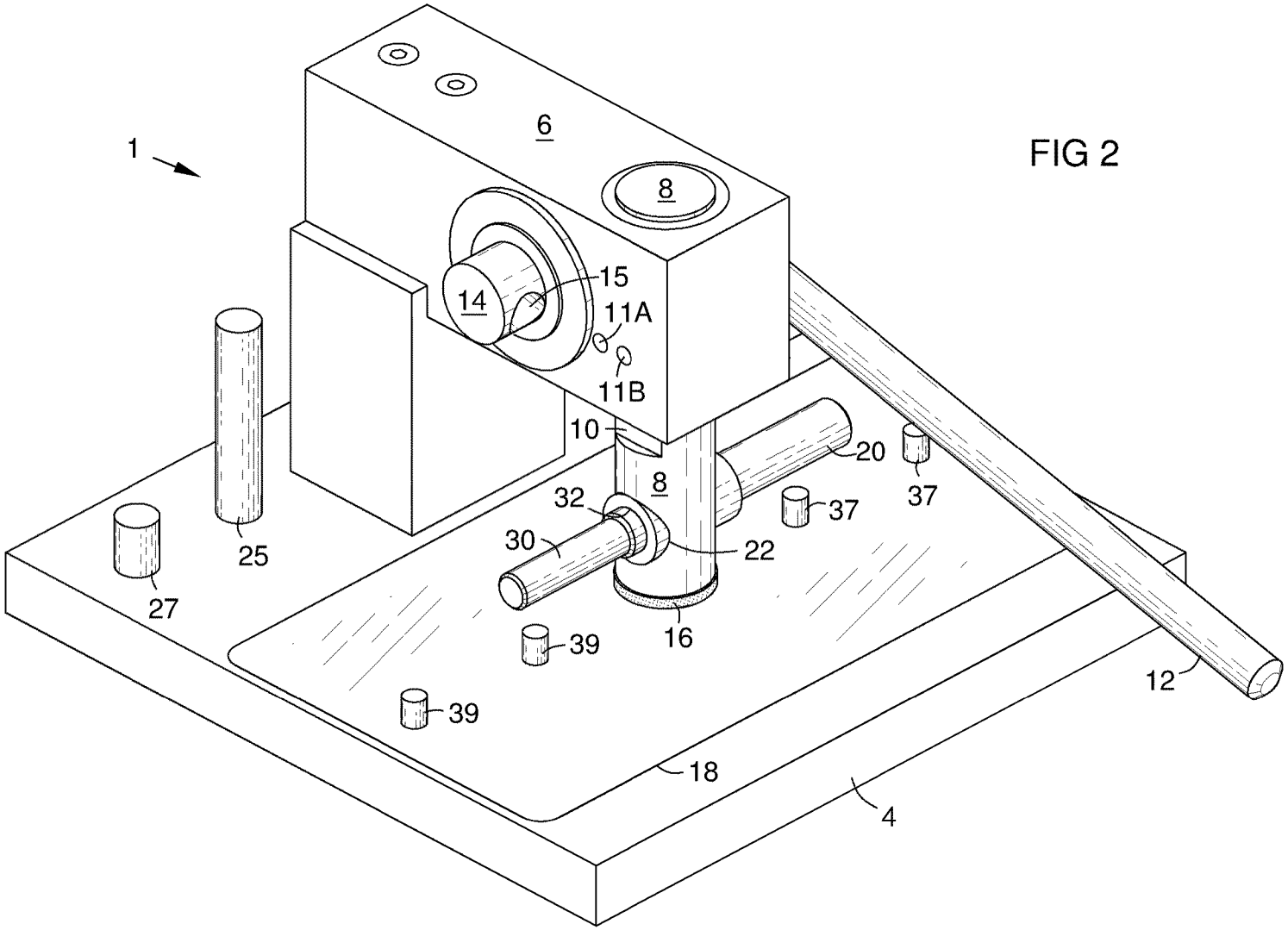
FIG. 2 is a perspective view of the press with forming blocks and sleeves removed.

FIG. 2 shows the press with the bracelet sleeves and the forming blocks removed showing storage pins 25, 27 for the bracelet sleeves, mounting pins 37, 39 for the bracelet forming block or the ring forming block of FIG. 1. Mounting elements for the lever 12, mandrel/receiver 20, and pins 37, 39 for the forming blocks may be laterally symmetric, so the bracelet and ring forming mandrels and blocks can be placed on either side of the ram per user preference, and for left or right-handed use.

FIG. 3 shows the ram 8 with the flat side portion 10 and the lateral through-hole 22 to mount the mandrel/receiver 20. A pin 40 in the lateral hole retains the mandrel receiver via a twist locking mechanism. The pin 40 is shown centered at the bottom of the lateral hole 22, but it may be centered anywhere around the lateral hole.

FIG. 4 shows a mandrel/receiver 20 comprising a mandrel 20A with a mounting portion 20B that fits closely within the lateral through-hole 22 in the ram 8. Herein, "closely fits" means the mounting portion 20B fits in the hole 22 with clearance that allows manual insertion and removal with minimal play considering manufacturing tolerances and differential thermal expansion during operation. For example a hole 22 with a diameter of 1.0000 inch and a mandrel mounting portion 20B with a diameter of 0.9985 inch works well. In general, a diametric clearance of 0.0010 to 0.0030 inch is suggested. The mounting portion has an axial groove 20C oriented with an axis 42 of the mandrel/receiver. A circumferential groove 20D intersects the axial groove to receive the pin 40 after insertion of the mandrel/receiver into the hole 22 with the axial groove downward, then twisting the mandrel/receiver. The mandrel/receiver is shown rotated 90 degrees clockwise from the insertion position so the axial groove 20C is visible. No flexing parts are needed to aid retention in this twist-lock mechanism because the mandrels 20 and 30 do not tend to twist during use. Friction in the lateral hole 22 prevents twisting of the mandrel when cantilever force on the mandrel is present during jewelry making. The mounting portion 20B has a receiving cavity 32 that receives and mounts a mounting portion 30B of a second mandrel 30 to extend on the opposite side of the ram 8. No axial retention mechanism is needed to retain the second mandrel in the receiving cavity 32. Friction in the receiving cavity during cantilever force on the second mandrel prevents movement of the second mandrel. The assembled configuration is shown in FIG. 1.

FIG. 5 shows a ring forming block 34 with two ring forming channels 34A and 34B of different widths. Two pairs of mounting holes 38A and 38B are used to mount the block onto pairs of pins 37 or 39 on the base of the press. Mounting the block using the two holes 38A aligns channel 34A with a ring forming mandrel in the ram. Mounting the block using the two holes 38B aligns channel 34B with the ring forming mandrel in the ram. The forming blocks may be made of a rigid and tough but semi-soft material such as Delrin® that grips the silverware and does not scratch it. Such material gradually wears over time. To increase the lifetime of the block it may be made at least twice as long L2 as a length L1 (FIG. 3) of the mandrel overlap over the block. This allows the block 34 to be turned 180 degrees to present a new wear surface in each channel, doubling its wear lifetime.

Figure 6:
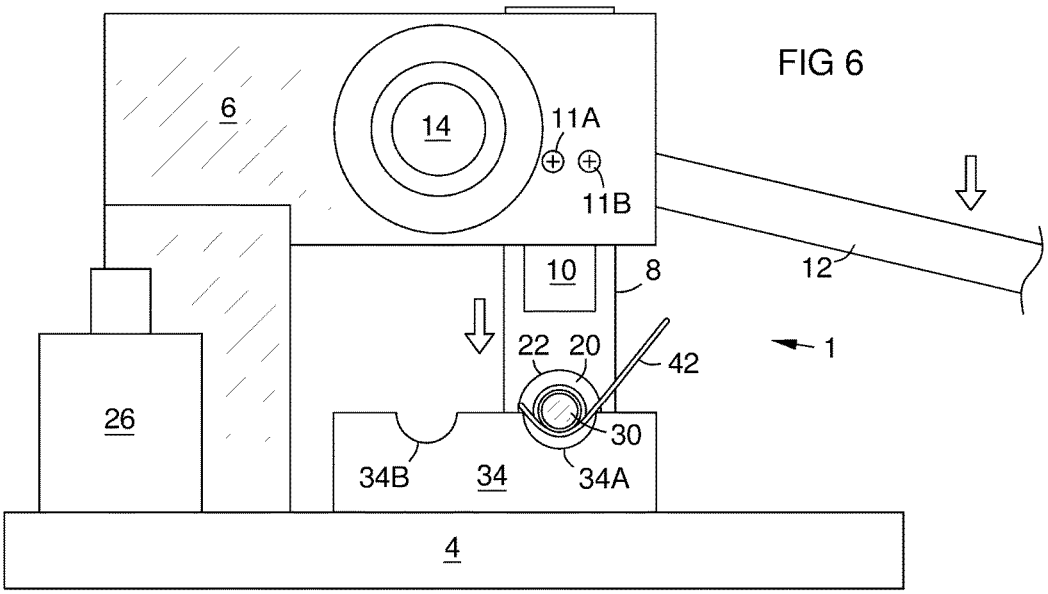
FIG. 6 is a left side view of the press showing a ring forming step.

FIG. 6 shows a left side view of the press 1 with a workpiece 42 being bent between a ring-forming mandrel 30 and a ring-forming channel 34A in a forming block 34. The workpiece may be silverware such as a metal spoon, knife, or fork. It may first be flattened between the pad 16 (FIG. 1) on the bottom of the ram 8 and the metal plate 18 in the base 4 before performing the bending operation shown.

Figure 7:
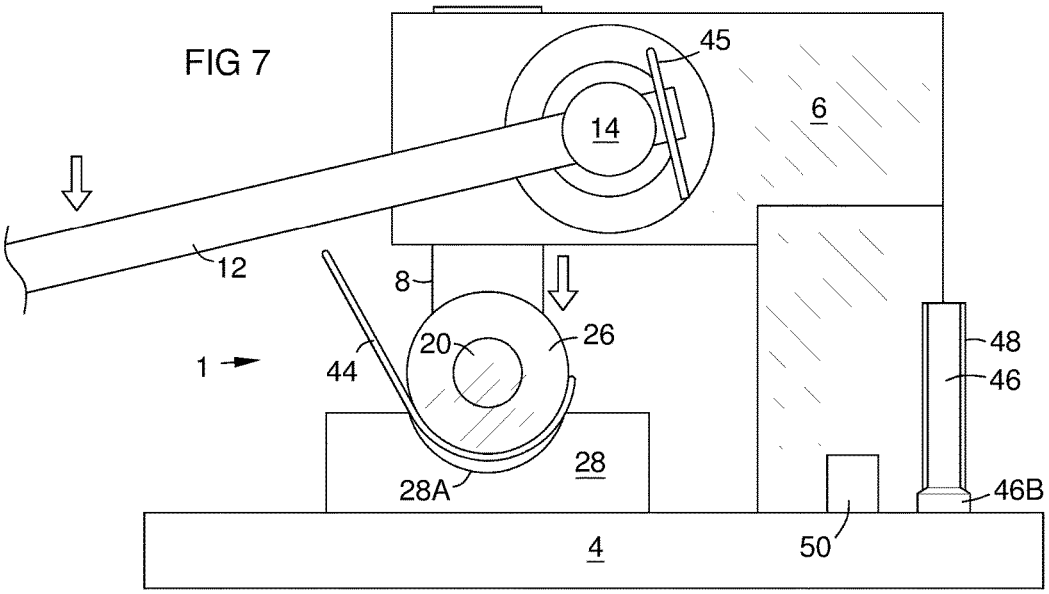
FIG. 7 is a right side view of the press showing a bracelet forming step.

FIG. 7 shows a right side view of the press with a workpiece 44 being bent between a bracelet-forming sleeve 26 on a mandrel 20 and a channel 28A in a bracelet-forming block 28. The lever 12 may be retained in a hole through the axle 14 by a quickly releasable device such as a cotter pin or a hairpin clip 45. The lever can be quickly moved from the right side of the arm 6 as shown to the left side for use by a user's left hand on the lever with the right hand holding the workpiece 44 between the mandrel 20 and forming block 28 on the right side. A selection of ring mandrels 46, 48 of different sizes may be stored in blind holes in the base 4 for quick selection, mounting, and interchanging in the ram 8. Each ring mandrel has the same diameter base 46B for insertion into the receiving cavity 32 of the mandrel/receiver 20 as shown in FIG. 4. A blind hole or a pin 50 may be provided to store the mandrel/receiver 20 on the base.

Figure 8:
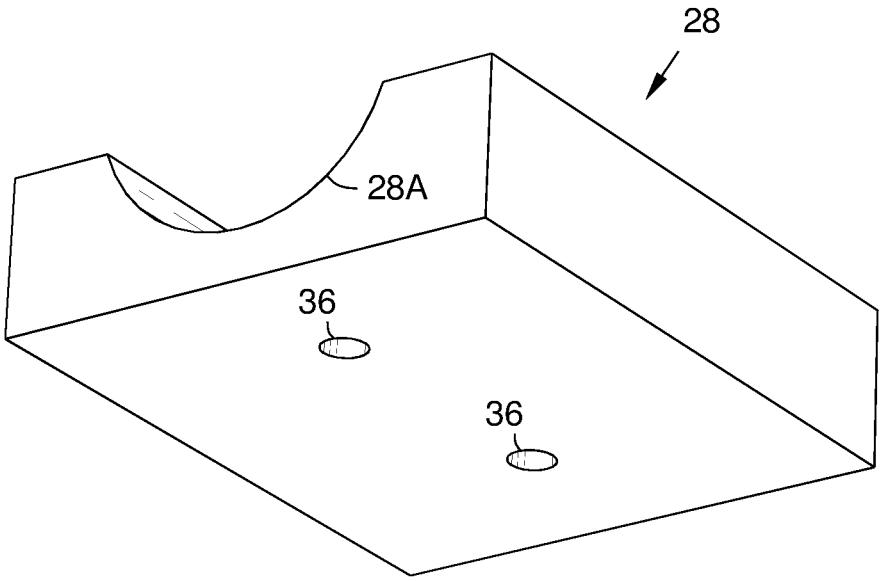
FIG. 8 is a perspective bottom view of a bracelet-forming block.

FIG. 8 is a perspective view of a bracelet-forming block 28 with a channel 28A in the top surface of the block, and two holes 36 in the bottom of the block for mounting the block on the mounting pins 37 of FIG. 2.

The present jewelry-making press can be quickly configured and reconfigured without tools for making ring-shaped jewelry of different diameters from silverware or other flat workpieces. It provides mandrels and respective forming blocks on two sides of the ram and a lever that is quickly switchable to left-handed or right-handed operation for high productivity. It can be provided as a complete self-contained manually operated press with high mechanical advantage weighing less than 15 lbs. including a selection of forming blocks and mandrels of different sizes.

While various embodiments of the present invention have been shown and described herein, such embodiments are provided by way of example only. Variations, changes and substitutions may be made without departing from the invention herein.

The invention claimed is:

1. Apparatus for bending a workpiece comprising:

a vertically movable ram in a support structure on a horizontal base;

a lateral through-hole in the ram proximate a bottom end thereof;

first and second elongated mandrels, each mandrel comprising a mounting portion;

wherein the mounting portion of the first mandrel mounts in the lateral through-hole in the ram;

wherein the mounting portion of the first mandrel further comprises a receiving cavity that receives the mounting portion of the second mandrel;

wherein when the first mandrel is mounted in the through-hole of the ram, and the second mandrel is mounted in the receiving cavity of the first mandrel, the first mandrel extends horizontally from a first side of the ram, and the second mandrel extends horizontally from a second opposite side of the ram;

a first forming block mounted on the horizontal base on the first side of the ram, the first forming block comprising a top surface with a first channel below and aligned with the first mandrel; and a second forming block mounted on the horizontal base on the second opposite side of the ram, the second forming block comprising a top surface with a second channel below and aligned with the second mandrel;

wherein a downward force on the ram causes the first mandrel to move toward the first channel.

2. The apparatus of claim 1, further comprising:

a locating pin extending inward from an inner surface of the through-hole in the ram;

an axial groove on an outer surface of the mounting portion of the first mandrel, the axial groove aligned with a longitudinal axis of the first mandrel;

a circumferential groove on the outer surface of the mounting portion of the first mandrel that intersects the axial groove and receives the locating pin when the mounting portion of the first mandrel is inserted into the lateral through-hole in the ram with the locating pin in the axial groove, and then the first mandrel is twisted when the locating pin reaches the circumferential groove.

3. The apparatus of claim 2, wherein the mounting portion of the first mandrel has no flexing parts that flexibly retain the locating pin in the circumferential groove.

4. The apparatus of claim 1, wherein the ram comprises a flat side portion, and further comprising first and second horizontally spaced adjustment screws in the support structure that contact the flat side portion of the ram and provide rotational position adjustment of the ram in the support structure.

5. The apparatus of claim 1, further comprising:

a horizontal axle in the support structure, the horizontal axle comprising first and second ends extending from respective first and second sides of the support structure;

a rotary-to-linear conversion mechanism between the horizontal axle and the ram that converts rotation of the axle to linear motion of the ram; and an actuating mechanism releasably mountable alternately on the first or second end of the horizontal axle to turn the horizontal axle with selectable ambidextrous operation.

6. The apparatus of claim 5, wherein the actuating mechanism is a manual lever.

7. The apparatus of claim 1, further comprising a flat pad on the bottom end of the ram for flattening the workpiece against a portion of the horizontal base.

8. The apparatus of claim 1, wherein the first forming block is longer than the first mandrel in a direction of the first channel, and the first forming block is reversible on the horizontal base by 180 degrees about a vertical axis to selectively position alternate ends of the first channel below the first mandrel, providing a respectively different wear surface in each end of the first channel.

9. The apparatus of claim 8, wherein the first forming block further comprises:

a bottom side with two holes that mate with a respective two vertical pins on a top surface of the horizontal base on the first side of the support structure to position the first channel of the first forming block directly below the first mandrel.

10. The apparatus of claim 1, wherein the second forming block further comprises a third channel in the top surface thereof, the third channel having a different width than the second channel, wherein the second forming block is movable on the horizontal base to position either the second or third channel directly below the second mandrel.

11. The apparatus of claim 10, wherein the second forming block comprises a bottom side with two pairs of holes, each said pair of holes mating alternately with two vertical pins on a top surface of the horizontal base on the second side of the support structure in two alternate positions of the second forming block that respectively position the second channel or the third channel of the second forming block directly below the second mandrel.

12. The apparatus of claim 10, wherein the second forming block is longer than the second mandrel in a direction of the second and third channels, and the second forming block is reversible on the horizontal base by 180 degrees about a vertical axis to position alternate ends of the second and third channels below the second mandrel, providing a respectively different wear surface in each end of each of the second and third channels.

13. The apparatus of claim 1, further comprising a set of workpiece pressing sleeves that interchangeably slide over the first mandrel, and are stored on the base when not in use, wherein at least two sleeves of the set comprise respectively different outer diameters.

14. The apparatus of claim 1, further comprising a set of interchangeable second mandrels that are stored on the base when not in use, each of which comprising a mandrel mounting portion that fits into the receiving cavity in the first mandrel, wherein at least two of the interchangeable second mandrels of the set comprise respectively different outer diameters.

15. Apparatus for bending a workpiece comprising:

a vertically movable ram in a support structure on a horizontal base;

a lateral through-hole in the ram proximate a bottom end thereof;

a locating pin extending inward from an inner surface of the through-hole in the ram;

an elongated first mandrel comprising a first mounting portion that fits in the through-hole in the ram;

an axial groove on an outer surface of the first mounting portion of the first mandrel, the axial groove being aligned with a lengthwise axis of the first mandrel;

a circumferential groove on the outer surface of the first mounting portion of the first mandrel that intersects the axial groove and receives the locating pin when the first mounting portion of the first mandrel is inserted into the lateral through-hole in the ram with the locating pin in the axial groove and the first mandrel is twisted when the locating pin reaches the circumferential groove;

wherein when the first mandrel is mounted in the through-hole of the ram, the first mandrel extends horizontally from a first side of the ram; and a first forming block mountable on the horizontal base beside the ram, the first forming block comprising a top surface with a first channel below and aligned with the first mandrel;

wherein a downward force on the ram causes the first mandrel to move toward the first channel.

16. The apparatus of claim 15, wherein the first forming block further comprises a bottom side with a plurality of holes that mate with a corresponding plurality of vertical pins on a top surface of the horizontal base on the first side of the ram that positions the first channel of the first forming block directly below the first mandrel in either of two alternately selectable positions 180 degrees apart.

17. The apparatus of claim 15, further comprising:

a second mandrel comprising a second mounting portion;

wherein the first mounting portion of the first mandrel further comprises a receiving cavity that receives the second mounting portion of the second mandrel;

wherein when first mounting portion is mounted in the through-hole of the ram, and the second mounting portion of the second mandrel is inserted into the receiving cavity of the first mandrel, the second mandrel extends horizontally from the mounting portion of the first mandrel on an opposite side of the ram from the first mandrel.

18. The apparatus of claim 17, further comprising a second forming block comprising second and third channels in the top surface thereof, the second channel having a different width than the third channel, wherein the second forming block is mountable on vertical pins on the horizontal base to alternately position a first end or a second end of the second channel and the third channel directly below the second mandrel, providing a selectable wear portion at each end of each of the second and third channels.

19. The apparatus of claim 18, wherein the second forming block comprises a bottom side with a plurality of holes that mate with a corresponding plurality of vertical pins on a top surface of the horizontal base on said opposite side of the ram in four alternately selectable positions of the second forming block that respectively position the first end or the second end of the second channel or the third channel of the second forming block directly below the second mandrel.

20. The apparatus of claim 17 wherein the first mandrel is mountable in the lateral through-hole of the ram without tools, and the second mandrel is mountable in the receiving cavity of the first mandrel without tools.

* * * * *